US009297215B2

(12) United States Patent
Craik

(10) Patent No.: US 9,297,215 B2
(45) Date of Patent: Mar. 29, 2016

(54) SYSTEM AND METHOD FOR PROVIDING POWER, TWO-WAY COMMUNICATION, AND OPERATION OF DOWNHOLE TOOLS IN A HORIZONTAL WELLBORE

(71) Applicant: Ron Craik, Calgary (CA)

(72) Inventor: Ron Craik, Calgary (CA)

( * ) Notice: Subject to any disclaimer, the term of this patent is extended or adjusted under 35 U.S.C. 154(b) by 499 days.

(21) Appl. No.: 13/756,183

(22) Filed: Jan. 31, 2013

(65) Prior Publication Data

US 2013/0192850 A1 Aug. 1, 2013

Related U.S. Application Data

(60) Provisional application No. 61/593,199, filed on Jan. 31, 2012.

(51) Int. Cl.
*E21B 17/02* (2006.01)
*H01R 13/523* (2006.01)

(52) U.S. Cl.
CPC ..... *E21B 17/028* (2013.01); *E21B 17/023* (2013.01); *E21B 17/026* (2013.01); *H01R 13/523* (2013.01)

(58) Field of Classification Search
CPC .... E21B 17/026; E21B 17/028; H01R 13/523
USPC ..... 166/242.6
See application file for complete search history.

(56) References Cited

U.S. PATENT DOCUMENTS

| | | | | |
|---|---|---|---|---|
| 4,258,792 | A * | 3/1981 | Restarick | 166/378 |
| 2007/0218775 | A1 * | 9/2007 | Coronado | 439/681 |
| 2009/0078429 | A1 * | 3/2009 | Du et al. | 166/378 |
| 2013/0299174 | A1 | 11/2013 | Baski | |

FOREIGN PATENT DOCUMENTS

| | | | | |
|---|---|---|---|---|
| GB | 2295409 | A * | 5/1996 | E21B 47/12 |

* cited by examiner

*Primary Examiner* — Jennifer H Gay
*Assistant Examiner* — George Gray
(74) *Attorney, Agent, or Firm* — Donald V. Tomkins

(57) ABSTRACT

A wireline extension assembly includes a first tubing string housing a wireline extension electrically interconnecting wet connects at the upper and lower ends of the first string, with the lower wet connect being electrically connected to a downhole tool. The assembly is pushed into the horizontal leg of a deviated wellbore by forming a second tubing string extending upward from the upper end of the first string, thereby positioning the tool within the horizontal leg while leaving the upper wet connect disposed within the vertical leg. A primary wireline is then run from a surface wireline unit into the upper string and connected to the upper wet connect, thus providing electrical power, data communication, and/or other facilities to the tool. The tool can be repositioned within the horizontal leg by withdrawing the primary wireline, removing or upper string tubing sections, and then reinstalling the primary wireline.

16 Claims, 4 Drawing Sheets

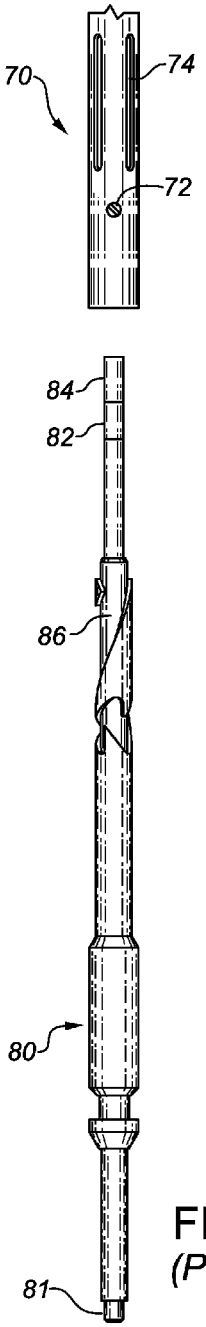
FIG. 3A
(Prior Art)
FIG. 3B (Prior Art)
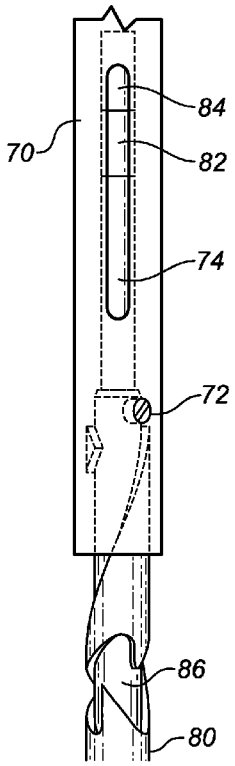

SYSTEM AND METHOD FOR PROVIDING POWER, TWO-WAY COMMUNICATION, AND OPERATION OF DOWNHOLE TOOLS IN A HORIZONTAL WELLBORE

FIELD

The present disclosure relates in general to systems and methods for providing power and data communication for downhole tools, in particular to systems and methods for providing power and data communication for downhole tools in horizontal wellbores and other non-vertical wellbores.

BACKGROUND

More and more oil and gas wells are being planned and drilled as horizontal wells. It is now accepted that production and/or economics from horizontal wells can be far greater than from vertical wells in the same formations. This is a relatively new trend and a lot of the techniques, technology, and accepted valuation methods that have worked on vertical wells do not work the same for horizontal legs of deviated wellbores. The industry is slowly catching up, but the efficiency and accuracy of the new technologies for horizontal wells can be very costly and are somewhat unreliable to date. There is a need for new systems and methods for adapting known technologies to provide intervention, methods, and data specifically suited for use with horizontal wells.

Adaptations that have been developed for horizontal wells include E-coil tubing, wireline well tractors, pump-down systems, etc. These services can be very expensive and time-consuming, and can add greatly to the cost of drilling and completing a horizontal well.

For these reasons, there is a need for systems and methods for providing power, two-way communication, and operation of downhole tools in horizontal and other non-vertical wellbores that are more reliable, cheaper, easier to maintain, easier to run, and less complicated than what is currently available.

BRIEF SUMMARY

In general terms, the present disclosure teaches a system and method whereby specialized equipment such as wireline logging tools, drillstem testing equipment, pressure recorders, temperature recorders, downhole pumps, and other equipment designed for vertical oil and gas wells can be adapted to run in horizontal and other non-vertical wellbores.

Such specialized equipment often requires external power, communication, and control inputs from the surface in order to operate valves, recording devices, etc. These facilities are often provided by means of a wireline with an electrical conductor or an armored cable with internal conductors. These tools and equipment items are attached to the wireline and lowered into the wellbore to the desired depths (such as by means of a winch at surface).

In vertical wellbores, the tools or equipment can be easily lowered to the bottom of the wellbore. However, in a wellbore transitioning from a vertical leg to a horizontal leg, the tools will tend to stop at the heel (i.e., the beginning of the horizontal leg) due to increased friction against the side of the wellbore. There needs to be some external force to pull or push the tool assemblies into and along the horizontal leg. Pump-down systems and wireline well tractors have been built to accomplish this task.

The present disclosure teaches the use of a horizontal leg extension for the wireline or armored cable. For purposes of this patent document, the horizontal leg extension may be alternatively referred to as a "wireline extension". The system taught by the present disclosure uses two "wet connects"; i.e., plug-in sockets connecting electrical power and signals in a wet downhole environment without shorting or loss of electronic communication. There are different types of wireline wet connects, but in general terms a wet connect comprises two components: a probe (male) section and an "overshot" (female) section. One example of a known wireline wet connect is disclosed in U.S. Pat. No. 5,358,418.

In accordance with the present disclosure, a first (or lower) wet connect is provided for connecting the wireline to a downhole tool or package of downhole tools, and a second (or upper) wet connect is provided for connecting the wireline extension to a primary wireline extending from surface into the vertical (or predominantly vertical) leg of a wellbore also having a horizontal (or otherwise non-vertical) leg. In one configuration of a wireline extension assembly in accordance with the disclosure, the length of the wireline extension will be slightly greater than the length of the horizontal leg of the wellbore (or greater in length than the distance that the extension needs to extend into the horizontal leg). This ensures that the male probe of the second (upper) wet connect will always be disposed (and oriented coaxially) within a lower region of the vertical leg of the wellbore (and not in the heel or in the horizontal leg), in order to facilitate connection to the primary wireline by means of the overshot section of the second wet connect.

However, wireline extension assemblies and related methods in accordance with the present disclosure are not limited or restricted to assemblies in which the male probe of the upper wet connect is always disposed within the vertical leg of the wellbore. In testing carried out by the inventor, wet connect overshots have been successfully connected to male probes that were oriented close to 30 degrees off vertical. Any limitations as to the range of angular orientations at which the male probe section of a wet connect could be successfully connected downhole to the corresponding overshot section generally will be a function of the type of wet connect used and any ancillary components for facilitating downhole mating of the male probe and overshot.

The broadest embodiments of wireline extension assemblies and related methods in accordance with the present disclosure are not intended to be limited or restricted to the use of any particular type of wet connect. Accordingly, wireline extension assemblies and related methods in accordance with the present disclosure are intended to cover embodiments using wet connects of either known or later-developed types in which the male probes and overshot sections (or analogous components) can be satisfactorily engaged when the wet connects are disposed within horizontal or otherwise non-vertical wellbore legs, or in a transition sections (e.g., heel sections) between contiguous wellbore legs of different angular orientations.

To assembly and install a wireline extension in accordance with the present disclosure into a wellbore, the first (lower) and second (upper) wet connects are run into the wellbore on a first (or lower) string of drill pipe or tubing, referred to herein as the extension string. The first (lower) wet connect is carried at the lower end of the extension string and the second (upper) wet connect is carried at the upper end of the extension string. The upper and lower wet connects are in electrical/electronic communication by means of a secondary wireline (the "wireline extension") disposed within the extension string.

A suitable derrick or service rig is used to push the extension string downward around the heel of the wellbore and into the horizontal leg as required, by adding additional tubing sections to the upper end of the extension string, thus forming second (or upper) tubing string disposed entirely within the vertical leg of the wellbore. After the extension string is thus in a desired position, with the upper wet connect still disposed within the vertical leg of the wellbore, a primary wireline is run from a surface wireline unit (typically a mobile wireline unit) into the upper tubing string and connected to the second (upper) wet connect so as to provide power, data communication, and/or other facilities to the tool package at the lower end of the extension string.

To reposition the tool package at a location within the horizontal leg but closer to the heel, the primary wireline is disconnected from the second (upper) wet connect and withdrawn from the upper tubing string, and then the derrick or service rig removes tubing sections from the upper end of the upper tubing string and draws it upward as required to move the tool package at the end of the extension string to the desired new position within the horizontal leg. The primary wireline is then inserted back into the upper tubing string for reconnection to the upper wet connect at the upper end of the extension string.

Similarly, the tool package can be moved further toward the toe of the wellbore (if there is room to do so) by withdrawing the primary wireline from the upper tubing string, adding tubing sections to the upper tubing string as appropriate to push the upper string toward the toe, and then re-inserting the primary wireline into the upper tubing string and reconnecting it to the upper wet connect at the upper end of the extension string. This operation requires, however, that the upper tubing string remains disposed within the vertical leg of the wellbore being thus lengthened.

In accordance with a first aspect, the present disclosure teaches a method for selectively positioning a downhole tool within a wellbore, including the steps of:

- providing first and second wet connects, each wet connect comprising a male probe and an overshot matingly engageable with the male probe;
- connecting the male probe of the first wet connect to a selected downhole tool to form a tool package;
- running a first tubing string into the wellbore to a selected depth, with the tool package being carried at the lower end of the first tubing string such that the male probe of the first wet connect projects into the first tubing string, and with the first tubing string having at its uppermost end a wet connect sub carrying the male probe of the second wet connect;
- providing a first wireline having an upper end and a lower end, and running the first wireline into the first tubing string with the overshot of the first wet connect attached to the lower end of the first wireline;
- latching the overshot of the first wet connect with the male probe of the first wet connect;
- connecting the upper end of the first wireline to the male probe of the second wet connect;
- running additional tubing into the wellbore to form a second tubing string of selected length contiguous with the upper end of the first tubing string;
- running a second wireline into the second tubing string, with the overshot of the second wet connect being attached to the lower end of the second wireline; and
- latching the overshot of the second wet connect with the male probe of the second wet connect, so as to effect an electrical/electronic connection between the downhole tool and the second wireline.

The method may include the additional steps of:

- unlatching the overshot of the second wet connect from the male probe of the second wet connect;
- withdrawing the second wireline from the second tubing string;
- making up additional tubing onto the upper end of the second tubing string so as to increase the length of the second tubing string by a desired amount, thus correspondingly relocating the downhole tool within the wellbore; and
- running the second wireline back into the second tubing string, and re-latching the overshot of the second wet connect with the male probe of the second wet connect.

The method may also include the additional or alternatively additional steps of:

- unlatching the overshot of the second wet connect from the male probe of the second wet connect;
- withdrawing the second wireline from the second tubing string;
- removing tubing from the upper end of the second tubing string so as to decrease the length of the second tubing string by a desired amount, thus correspondingly relocating the downhole tool within the wellbore; and
- running the second wireline back into the second tubing string, and re-latching the overshot of the second wet connect with the male probe of the second wet connect.

In accordance with a second aspect, the present disclosure teaches a wireline extension assembly including:

- a first tubing string disposed within a wellbore, the first tubing string having an upper end and a lower end;
- a tool package comprising a downhole tool connected to a first wet connect probe, the tool package being connected to the lower end of the first tubing string such that the first wet connect probe projects into the first tubing string;
- a wet connect sub carrying a second wet connect probe, the wet connect sub being connected to the upper end of the first tubing string;
- a first wet connect overshot in latching engagement with the first wet connect probe; and
- a first wireline connecting the first wet connect overshot and the second wet connect probe.

The wireline extension assembly may also include a second tubing string contiguously extending from the upper end of the first tubing string, plus a second wireline having a lower end connected to a second wet connect overshot, and with the second wet connect overshot being in latching engagement with the second wet connect probe.

BRIEF DESCRIPTION OF THE DRAWINGS

Embodiments in accordance with the present disclosure will now be described with reference to the accompanying figures, in which numerical references denote like parts, and in which:

FIGS. 3A and 3B illustrate the components of an exemplary prior art wet connect.

DETAILED DESCRIPTION

Figure 1:
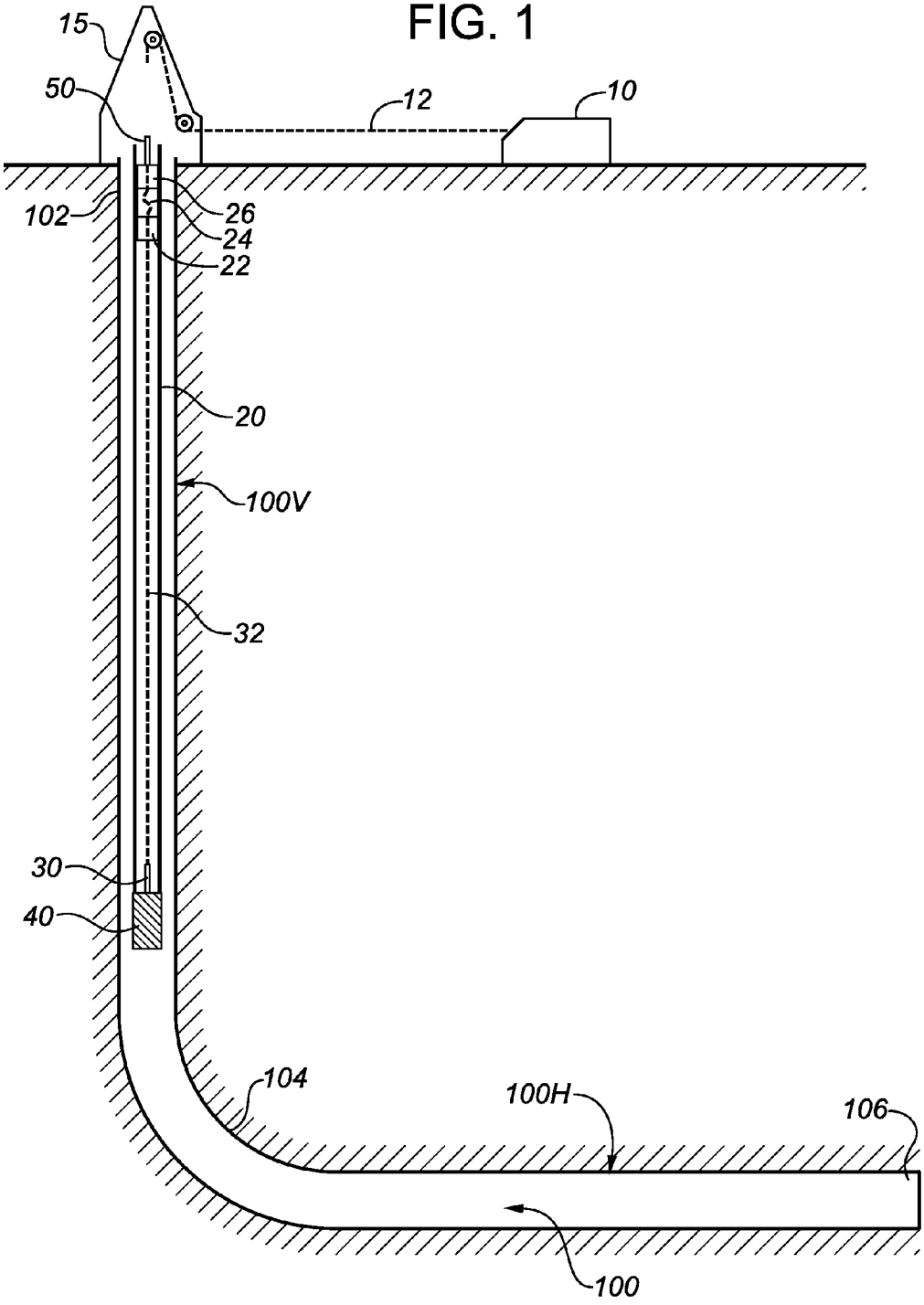
FIG. 1 schematically illustrates a wellbore having vertical and horizontal legs, with a wireline extension in accordance with the present disclosure disposed within the vertical leg of the a wellbore.
Figure 2:
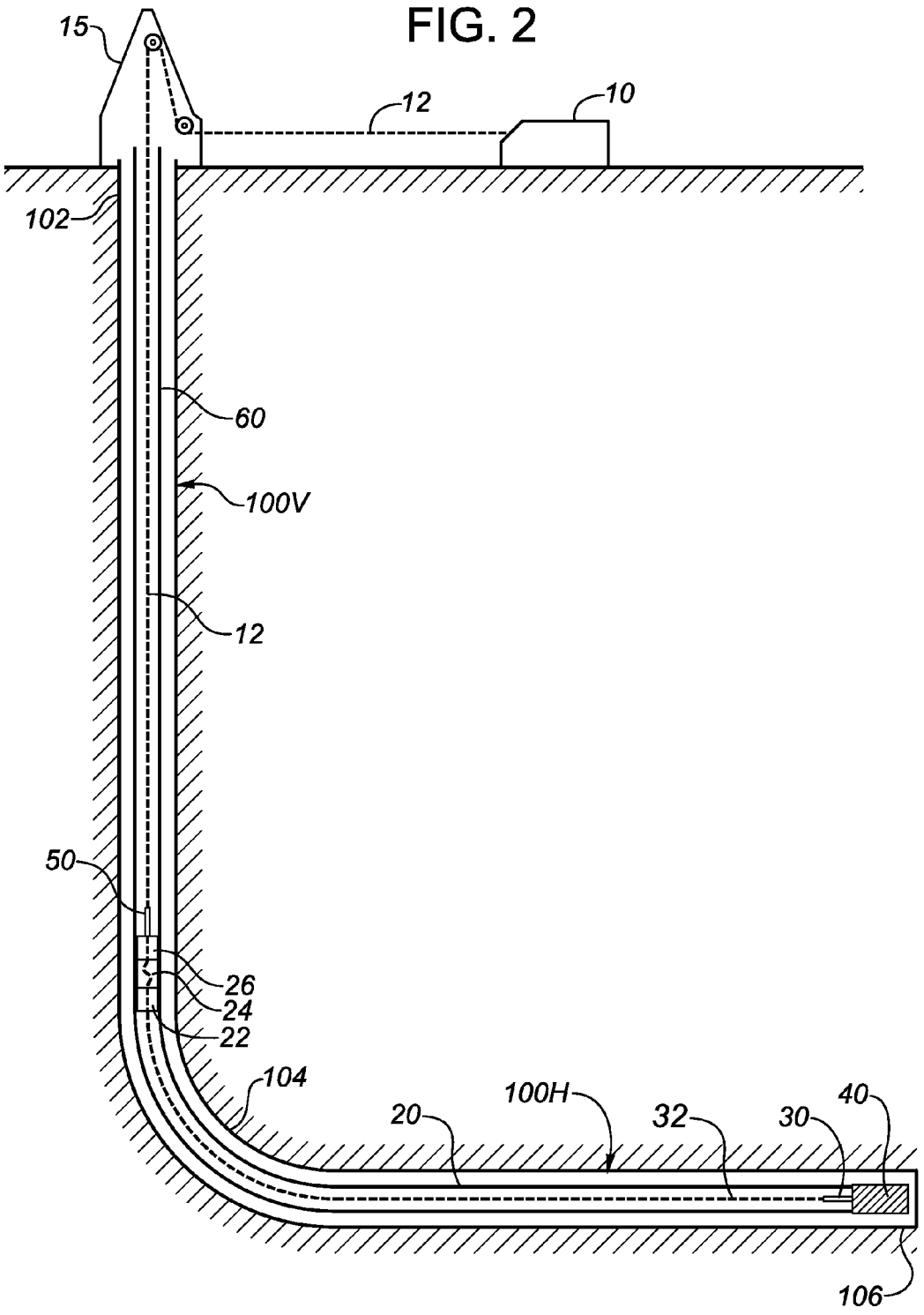
FIG. 2 is a schematic illustration similar to FIG. 1, showing the wireline extension disposed partially within the horizontal leg of the wellbore and connected to a primary wireline running to the surface through an upper tubing string.

FIG. 1 schematically illustrates a wellbore 100 having a vertical leg 100V having an upper end 102, a heel section 104, and a horizontal leg 100H extending to a toe end 106. In accordance with the present teachings, one or more desired downhole tools 40 may be made up at surface with the male probe of a first (or lower) wet connect 30. This assembly of the lower wet connect probe and tool (or tool package) 40 is run into vertical wellbore leg 100V at the lower end of a first or lower tubing string 20 (alternatively referred to herein as extension string 20). First (lower) wet connect 30 may be housed or carried by a suitable wet connect sub 26 incorporated into first (lower) tubing string 20 as shown in FIGS. 1 and 2 (the term "sub" being commonly used in the oil and gas industry to denote any small or secondary component in a tubing string).

A surface rig (derrick) 15 is used to lower this assembly into vertical wellbore leg 100V to a selected depth corresponding to the distance that tool package 40 is intended to extend into horizontal leg 100H. This is done by adding tubing sections to extension string as required until it reaches the desired length.

At this stage, a wireline extension 32 is lowered down the inside of extension string 20 by means of a wireline unit 10 associated with rig 15, with the overshot (female) section of first (lower) wet connect 30 attached by means of a cable head to the bottom end of wireline extension 32, until the overshot section latches onto the male probe section of first (lower) wet connect 30 on tool package 40.

The upper end of wireline extension 32 is then connected to the male probe section of a second (or upper) wet connect 50, which is carried by the upper end of extension string 20. Depending on the particular type of wet connects used, it may be necessary or desirable to provide means for maintaining tension in wireline extension 32 and thus prevent inadvertent disengagement of first wet connect 30 from downhole tool(s) 40. This would be particularly desirable for embodiments in which first (lower) wet connect 30 is held in the latched position by means of a conventional J-slot-and-pin arrangement (the details and operation of which will be familiar to persons skilled in the art). This style of wet connect requires some tension on the wireline so that it will remain latched.

Persons skilled in the art will appreciate that means for maintaining tension in wireline extension 32 could be provided in various different ways, and embodiments in accordance with the present disclosure that incorporate such means are not limited or restricted to any particular such means. By way of non-limiting example, however, means for maintain tension in the wireline extension could be provided in the form of a tensioner sub 22 near the upper end of extension string 20, and incorporating a cable clamp (not shown) that is bolted wireline extension 32 with a stop shoulder in the bottom of tensioner sub 22.

In some cases it may be desirable or necessary to add one or more tubing sections 24 to extension string 20 to serve as spacers (or "spacer subs") so as to match the length of any extra length of wireline extension 32 between wet connect sub 26 and tensioner sub 22. The need for such spacers may arise in particular in cases where wireline extension 32 comprises armored conductor cable or similarly rigid electric line.

The purposes of such spacers would be to prevent such extra length of wireline cable from becoming kinked or coming under too much stress (such as from flexure). This "space-out" provided by spacer sub(s) 24 will allow the male probe of second (upper) wet connect 50 to be held in a fixed position in wet connect sub 26. More specifically, wet connect sub 26 holds the male probe of second (upper) wet connect 50 such that it cannot move up or down, and also substantially centers the male probe within extension string 20 and prevents it from falling over and lying against the inside diameter of a second (upper) tubing string 60 subsequently connected to extension string 20 (as described in further detail below). This facilitates easier latching and un-latching of the female overshot section of second (upper) wet connect 50 (as described in further detail below).

The above-described need or desirability for spacers could arise, for instance, where a wireline extension assembly has been prepared for use in a particular wellbore and to have a certain set length (i.e., a "set string") and to be used in multiple wellbores of similar dimensions, and it is desired to use that assembly in a wellbore of different dimensions.

However, spacers generally should not be required if a particular wireline extension assembly is to be used in multiple wellbores of substantially similar dimensions. In that scenario, once the initial "space-out" on the first well has been done, it should typically be possible to run the same assembly into each subsequent similar well, in the same order of assembly, without the need to make corrections or compensate for any slight well variables. It would not be necessary to do a space-out procedure for each subsequent well in the series of similar wells. The tubing sections and subs that were run in below the second (upper) wet connect and making up the extension string for the first well (a "set string") would be put aside, and if this set of tubing components is to be run again into a second similar wellbore the space-out inherently provided by the set string should be appropriate for the second wellbore.

After the wireline extension assembly comprising extension string 20 and wireline extension 32 has been assembled as described above, additional tubing can then be added to the upper end of extension string 20 to form a second (or upper) tubing string 60, until the completed wireline extension assembly has been pushed around heel 104 of wellbore 104 and extends to toe 106 of horizontal leg 100H of wellbore 100 as shown in FIG. 2 (or a desired distance into horizontal leg 100H short of toe 106, as may be dictated by operational parameters). Because the length of the wireline extension has been selected to exceed the distance to which downhole tools 40 are intended to extend into horizontal leg 100H (as previously discussed), the male probe of second (upper) wet connect 50 will remain disposed within vertical leg 100V of wellbore 100 after the wireline extension has been positioned within horizontal leg 100H.

At this stage, a wireline unit 10 (of known type) at surface lowers a primary wireline 12 into upper tubing string 60, with the overshot section of second (upper) wet connect 50 having been connected to the lower end of primary wireline 12 at surface. Lowering of primary wireline 12 continues until the overshot section of second (upper) wet connect 50 engages the male probe of second wet connect 50, thus establishing electrical/electronic communication between primary wireline 12 and the downhole tool package 40 at the end of the wireline extension assembly. The tools can then be powered and operated, and measured data can be transmitted from the tools to the surface for recordation.

Using this system, the entire length of horizontal leg 100H can be mapped or tested without needing to remove downhole tools 40 from wellbore 100. Tool package 40 can be moved to a new position within horizontal leg 100H by simply unlatching second wet connect 50 within upper tubing string 60, withdrawing primary wireline 12 from upper tubing string 60 (by means of wireline unit 10 at surface), using surface rig 15 to remove tubing sections from upper tubing string 60 as necessary to move tool package 40 a desired distance away from the toe 106 of horizontal leg 100H, and then running primary wireline 12 back into upper tubing string 60 string and re-latching it to second wet connect 50. This procedure can then be repeated as many times as necessary to test or log a desired length of the horizontal leg of the wellbore.

FIGS. 3A and 3B illustrate the male probe section 80 and female overshot section 70 of a prior art wet connect using a J-slot-and-pin latching mechanism. FIG. 3A illustrates the complete male probe section 80, aligned with the typically cylindrical lower portion of overshot section 70. A latching pin 72 projects radially into the bore of the lower portion of overshot 70, which typically has one or more longitudinal slots 74. Male probe 80 has a lower end 81 adapted for connection to a wireline, an electrical contact 84 (typically copper) at its upper end, and an insulator 82 for electrically isolating contact 84 from the main body of probe 80.

A medial region of probe 80 is machined or otherwise formed to define a generally helical "J-slot" section 86, which will receive latching pin 72 when probe 80 is inserted into overshot 70 as illustrated in FIG. 3B. J-slot 86 is configured such that when latching pin 72 has traveled to the lower end of J-slot 86, a tensile force applied to the wet connect assembly will cause latching pin 72 to become lodged in a pin-receiving pocket associated with J-slot 86 such that overshot 70 and probe 80 are mechanically latched. In FIG. 3B, conductor 82 can be seen through longitudinal slot 74 in overshot 80, moving upward within overshot 80 to engage a mating electrical contact (not visible) inside overshot 80. Probe 80 will typically be provided with a suitable swivel joint to prevent twisting of a wireline connected to the probe's lower end 81 as latching pin 82 travels within the generally helical J-slot 86.

However, systems and methods in accordance with the present disclosure are not limited or restricted to the use of wet connects using a J-slot-and-pin latching mechanism, or to any other particular type or types of latching mechanism. By way of non-limiting example, alternative latching mechanisms could use high-strength (e.g., neodymium) magnets, friction, suction, or mechanical collets.

Figure 4:
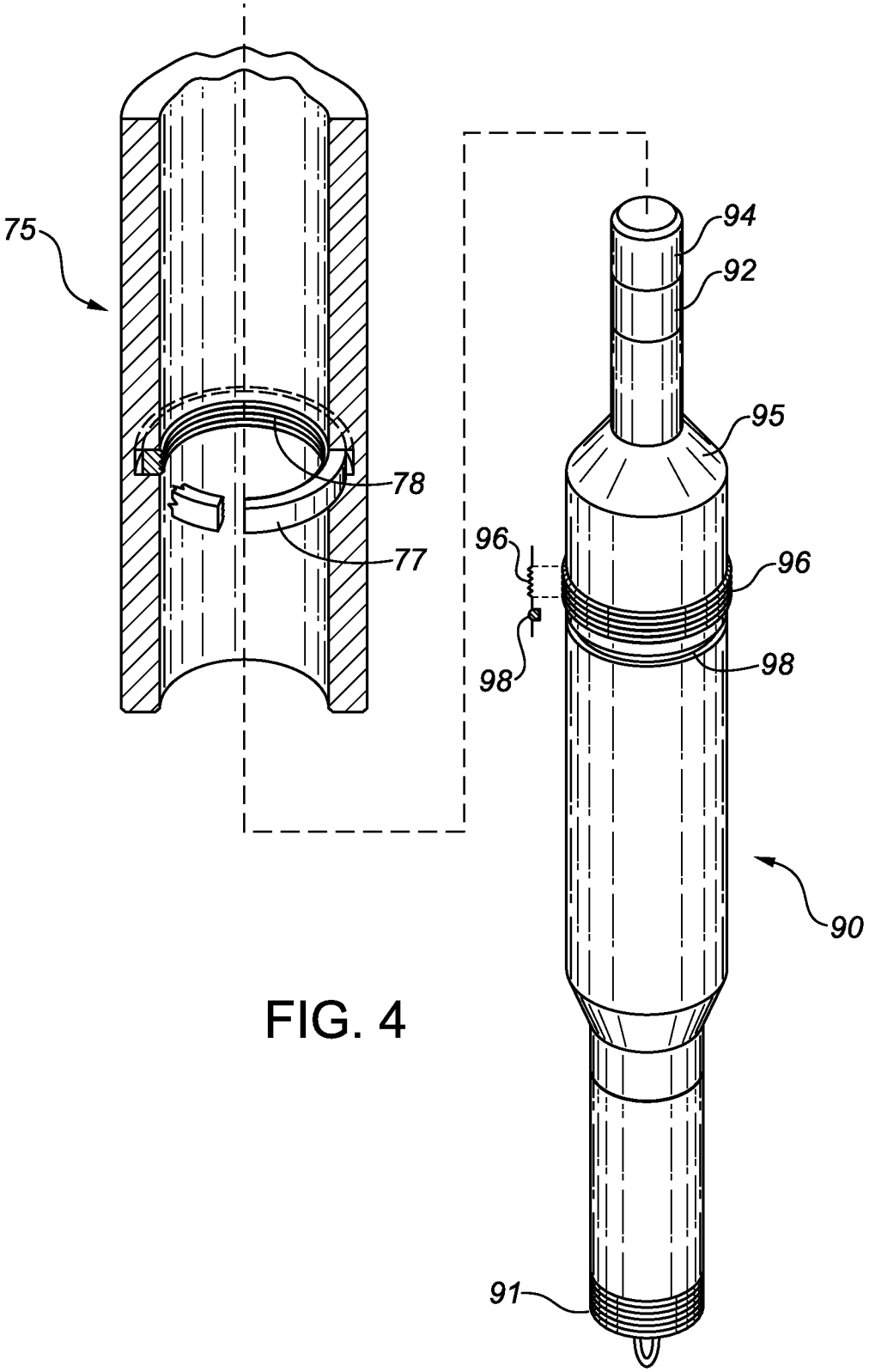
FIG. 4 illustrates the components of an alternative wet connect.

One non-limiting example of an alternative wet connect latching mechanism is illustrated in FIG. 4, and comprises a female overshot section 75 and a male probe section 90. Overshot 75 has a collet ring 77 disposed within an annular groove in the bore of overshot 75, with collet ring 77 being in the form of a split ring with annular thread-like grooves 78 formed on its inside diameter. Male probe 90 has a lower end 91 adapted for connection to a wireline, and an electrical contact 94 and insulator 92 at its upper end. An upper medial region of probe 90 is formed with annular thread-like ridges, such that insertion of probe 90 into overshot 75 will cause elastic deformation of collet ring 77 to allow annular ridges 96 on probe 90 to engage annular grooves 78 on collet ring 77, thus mechanically latching or locking probe 90 within overshot 75 (until such time as a sufficient tensile force is applied to unlock probe 90 from overshot 75).

In a variant of the mechanism shown in FIG. 4, a suitably contoured magnet (not shown) could be housed within overshot 75 for magnet engagement with a complementarily contoured portion of probe 90. For example, the magnet could be of generally toroidal configuration with a central opening defining a frustoconical surface for mating engagement with a frustoconical shoulder 95 as shown in FIG. 4 on probe 90.

In another variant latching mechanism, the male probe and overshot could be connected by means of a friction lock and/or vacuum. This could be done by providing a resilient element such as an O-ring 98 disposed within a circumferential groove on probe 90 as shown in FIG. 4. In that alternative embodiment, the size of the O-ring and the amount of interference with the bore of overshot 75 will determine the magnitude of the axial force required to push probe 90 into latching engagement with overshot 75 or to withdraw probe 90 out of engagement with overshot 75.

Systems and methods in accordance with the present disclosure are also not limited or restricted to the use of any particular type of wireline. In some embodiments, the wireline could be a braided wireline having a single conductor cable for use as the power and communication means. In alternative embodiments, the wireline could comprise a multi-conductor cable instead of a single conductor, with the number of conductors being selected to suit the specific requirements (e.g., power and data transmission) of the downhole tool or tools being used, Another option, depending on operational requirements, would be a wireline comprising a single conductor cable having an armored casing or shell made of stainless steel or other durable protective material.

A further alternative would be to use "E-coil" for the wireline extension instead of conventional wireline. E-coil has been around for many years, and is simply coiled tubing with either braided wireline or armored conductor cable inserted into the length of the tubing.

Each of these wireline alternatives has advantages and disadvantages. Unlike braided wireline, E-coil most likely would not require a swivel or a tensioner sub. This may also be true for armored conductor cable as well. If a set string of tubing/drill pipe is used on the horizontal leg, then a spacer system might not be required. If the wet connect latching mechanism uses collets or magnets, then a tensioner system may not be required.

It is to be understood that the scope of the claims appended hereto should not be limited by the preferred embodiments described and illustrated herein, but should be given the broadest interpretation consistent with the description as a whole. It is also to be understood that the substitution of a variant of a claimed element or feature, without any substantial resultant change in functionality, will not constitute a departure from the scope of the disclosure.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element. Any use of any form of the terms "connect", "engage", "couple", "attach", or any other term describing an interaction between elements is not meant to limit the interaction to direct interaction between the subject elements, and may also include indirect interaction between the elements such as through secondary or intermediary structure.

Relational terms such as but not limited to "vertical", "horizontal", and "coaxial" are not intended to denote or require absolute mathematical or geometrical precision. Accordingly, such terms are to be understood as denoting or requiring substantial precision only (e.g., "substantially vertical") unless the context clearly requires otherwise. Wherever used in this document, the terms "typical" and "typically" are to be interpreted in the sense of representative of common usage or practice, and are not to be understood as implying essentiality or invariability.

What is claimed is:

1. A method for selectively positioning a downhole tool within a wellbore, said method comprising the steps of:

(a) providing first and second wet connects, each wet connect comprising a male probe and an overshot matingly engageable with the male probe;

(b) connecting the male probe of the first wet connect to a selected downhole tool to form a tool package;

(c) running a first tubing string into the wellbore to a selected depth, said first tubing string having an uppermost end and a lower end, with the tool package being carried at the lower end of said first tubing string such that the male probe of the first wet connect projects into the first tubing string, and with said first tubing string having at said uppermost end a wet connect sub carrying the male probe of the second wet connect;

(d) providing a first wireline having an upper end and a lower end, and running said first wireline into the first tubing string with the overshot of the first wet connect attached to the lower end of the first wireline;

(e) latching the overshot of the first wet connect with the male probe of the first wet connect;

(f) connecting the upper end of the first wireline to the male probe of the second wet connect;

(g) running additional tubing into the wellbore to form a second tubing string of selected length contiguous with the upper end of the first tubing string;

(h) running a second wireline into the second tubing string, with the overshot of the second wet connect being attached to the lower end of the second wireline;

(i) latching the overshot of the second wet connect with the male probe of the second wet connect, so as to effect an electrical/electronic connection between the downhole tool and the second wireline;

(j) unlatching the overshot of the second wet connect from the male probe of the second wet connect;

(k) withdrawing the second wireline from the second tubing string;

(l) making up additional tubing onto the upper end of the second tubing string so as to increase the length of the second tubing string by a desired amount, thus correspondingly relocating the downhole tool within the wellbore; and (m) running the second wireline back into the second tubing string, and re-latching the overshot of the second wet connect with the male probe of the second wet connect.

2. A method as in claim 1 wherein the first tubing string includes a tensioner sub associated with the wet connect sub.

3. A method as in claim 2 wherein the first tubing string includes a spacer sub disposed between the tensioner sub and the wet connect sub.

4. A method as in claim 1 wherein at least one of the first and second wet connects comprises a J-slot-and-pin latching mechanism.

5. A method as in claim 1 wherein at least one of the first and second wet connects comprises a collet-type latching mechanism.

6. A method as in claim 1 wherein at least one of the first and second wet connects comprises a magnetic latching mechanism.

7. A method as in claim 1 wherein at least one of the first and second wet connects comprises a vacuum-type latching mechanism.

8. A method as in claim 1 wherein the wellbore is a deviated wellbore.

9. A method for selectively positioning a downhole tool within a wellbore, said method comprising the steps of:

(a) providing first and second wet connects, each wet connect comprising a male probe and an overshot matingly engageable with the male probe;

(b) connecting the male probe of the first wet connect to a selected downhole tool to form a tool package;

(c) running a first tubing string into the wellbore to a selected depth, said first tubing string having an uppermost end and a lower end, with the tool package being carried at the lower end of said first tubing string such that the male probe of the first wet connect projects into the first tubing string, and with said first tubing string having at said uppermost end a wet connect sub carrying the male probe of the second wet connect;

(d) providing a first wireline having an upper end and a lower end, and running said first wireline into the first tubing string with the overshot of the first wet connect attached to the lower end of the first wireline;

(e) latching the overshot of the first wet connect with the male probe of the first wet connect;

(f) connecting the upper end of the first wireline to the male probe of the second wet connect;

(g) running additional tubing into the wellbore to form a second tubing string of selected length contiguous with the upper end of the first tubing string;

(h) running a second wireline into the second tubing string, with the overshot of the second wet connect being attached to the lower end of the second wireline;

(i) latching the overshot of the second wet connect with the male probe of the second wet connect, so as to effect an electrical/electronic connection between the downhole tool and the second wireline;

(j) unlatching the overshot of the second wet connect from the male probe of the second wet connect;

(k) withdrawing the second wireline from the second tubing string;

(l) removing tubing from the upper end of the second tubing string so as to decrease the length of the second tubing string by a desired amount, thus correspondingly relocating the downhole tool within the wellbore; and (m) running the second wireline back into the second tubing string, and re-latching the overshot of the second wet connect with the male probe of the second wet connect.

10. A method as in claim 9 wherein the first tubing string includes a tensioner sub associated with the wet connect sub.

11. A method as in claim 10 wherein the first tubing string includes a spacer sub disposed between the tensioner sub and the wet connect sub.

12. A method as in claim 9 wherein at least one of the first and second wet connects comprises a J-slot-and-pin latching mechanism.

13. A method as in claim 9 wherein at least one of the first and second wet connects comprises a collet-type latching mechanism.

14. A method as in claim 9 wherein at least one of the first and second wet connects comprises a magnetic latching mechanism.

15. A method as in claim 9 wherein at least one of the first and second wet connects comprises a vacuum-type latching mechanism.

16. A method as in claim 9 wherein the wellbore is a deviated wellbore.

* * * * *